US006339851B1

(12) United States Patent
Bergkvist

(10) Patent No.: US 6,339,851 B1
(45) Date of Patent: Jan. 22, 2002

(54) TOILET SEAT

(75) Inventor: Håkan Bergkvist, Bromma (SE)

(73) Assignee: Baby Björn AB, Danderyd (SE)

( * ) Notice: Subject to any disclaimer, the term of this patent is extended or adjusted under 35 U.S.C. 154(b) by 0 days.

(21) Appl. No.: 09/646,912

(22) PCT Filed: Feb. 25, 1999

(86) PCT No.: PCT/SE99/00266

§ 371 Date: Oct. 11, 2000

§ 102(e) Date: Oct. 11, 2000

(87) PCT Pub. No.: WO99/53818

PCT Pub. Date: Oct. 28, 1999

(30) Foreign Application Priority Data

Apr. 23, 1998 (SE) ..... 9801436

(51) Int. Cl.[7] ..... A47K 13/02
(52) U.S. Cl. ..... 4/239; 4/237
(58) Field of Search ..... 4/235, 239, 253, 4/237

(56) References Cited

U.S. PATENT DOCUMENTS

,507,841 A * 10/1893 Prindle ..... 4/253 X
1,089,040 A 3/1914 Block
1,304,095 A 5/1919 Ream
1,951,621 A 3/1934 Mayette ..... 4/239
2,687,535 A * 8/1954 Almorth ..... 4/239
2,955,296 A 10/1960 Zapolski ..... 4/239
5,191,660 A * 3/1993 Francke ..... 4/239

FOREIGN PATENT DOCUMENTS

GB 573004 11/1945
SE 502 022 7/1995

* cited by examiner

*Primary Examiner*—Charles E. Phillips
(74) *Attorney, Agent, or Firm*—Jacobson Holman, PLLC

(57) ABSTRACT

A toilet seat includes a seat ring (10) and means (14, 15, 16) for positioning the same relative to a toilet bowl. The positioning means include at least one pair of interconnected arms (14, 15) which are movably mounted on the seat ring (10) and capable of being brought synchronously to positions in which they engage the toilet bowl. The arms (14, 15) of each pair are designed for engagement with opposite inner surfaces or outer surfaces of the toilet bowl and are interconnected so as to move synchronously in opposite directions as they are brought to their positional settings.

20 Claims, 4 Drawing Sheets

TOILET SEAT

BACKGROUND OF THE INVENTION

1. Field of the Invention

The present invention relates to a toilet seat of the kind which includes a seat ring and means for positioning the same relative to a toilet bowl, wherein said positioning means include at least one pair of mutually connected arms which are movably mounted on the seat ring and adjustable synchronously to positions in which they engage the toilet bowl.

2. Description of the Related Art

Toilet seats of the aforedescribed kind or similar kinds are known, e.g., from U.S. Pat. Nos. 1,089,040, 1,304,095, 1,951,621, 2,687,535 and 2,955,296, GB-A-573 004 and SE-C-502 022. The seat positioning arms or like devices, which may be adapted to engage directly on the inside or on the outside of a toilet bowl or against the inside or outside of a seat ring that is already fitted to the toilet bowl, are individually adjustable. These known seat positioning devices have the drawback of not enabling the toilet seat to be readily positioned exactly centrally on toilet bowls or fitted seat rings of mutually different sizes and shapes. Corresponding problems exist with toilet seats where the positioning arms engage the underside of a seat ring fitted to the toilet bowl.

SUMMARY OF THE INVENTION

The object of the present invention is to provide a novel and improved toilet seat which will self-centre as it is fitted to a toilet bowl, either with or without a fitted seat ring.

It is proposed to this end that the arms of each pair of positioning arms of a toilet seat of the aforedescribed kind are designed for engagement with opposing inner or outer sides of the toilet bowl and are so interconnected as to move synchronously In mutually opposite directions when adjusted to their respective settings. The arms are preferably pivotal, although they may alternatively be made displaceable in an other known manner, said arms being interconnected so that movement of one arm in one direction will result in synchronous movement of the other arm in an opposite direction.

When pivotal arms are used, the arms may be pivotal about different, mutually spaced pivot shafts and synchronization of the pivotal movements of said arms can be achieved by providing the arms with mutually engaging ratchet quadrants. However, the arms of each pair of arms will preferably be pivotal about one and the same pivot shaft located in a symmetry plane that extends through the toilet seat.

BRIEF DESCRIPTION OF THE DRAWINGS

Further characteristic features of the invention are set forth in the accompanying dependent claims. The invention will be described below in more detail with reference to a preferred, exemplifying embodiment of an inventive toilet seat, and also with reference to the accompanying drawings, in which

Figure 1:
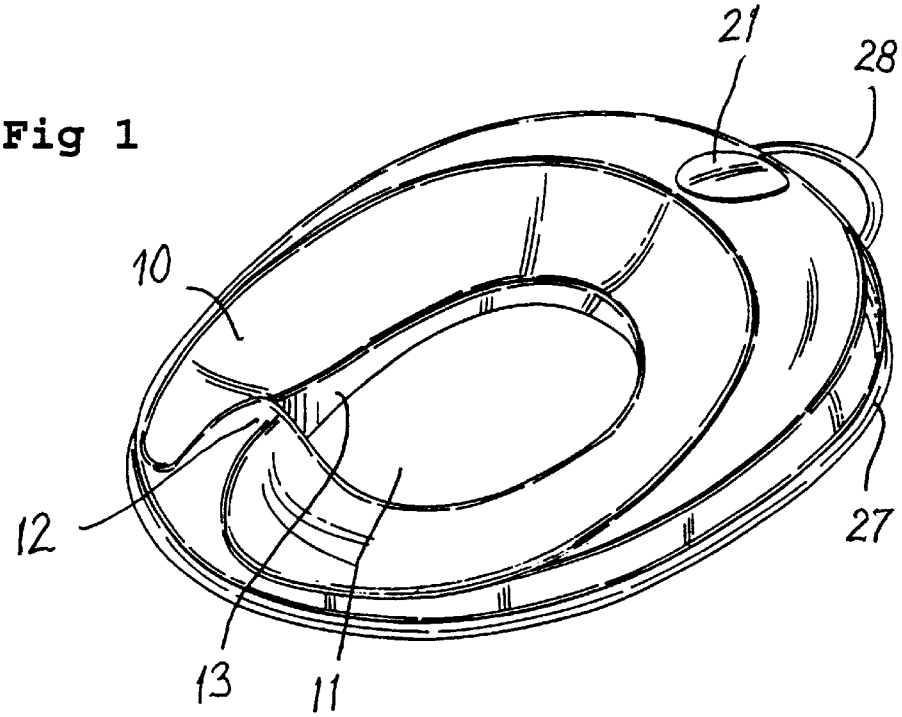
FIGS. 1 and 2 are perspective views of an inventive toilet seat seen obliquely from above and obliquely from beneath respectively.
Figure 2:
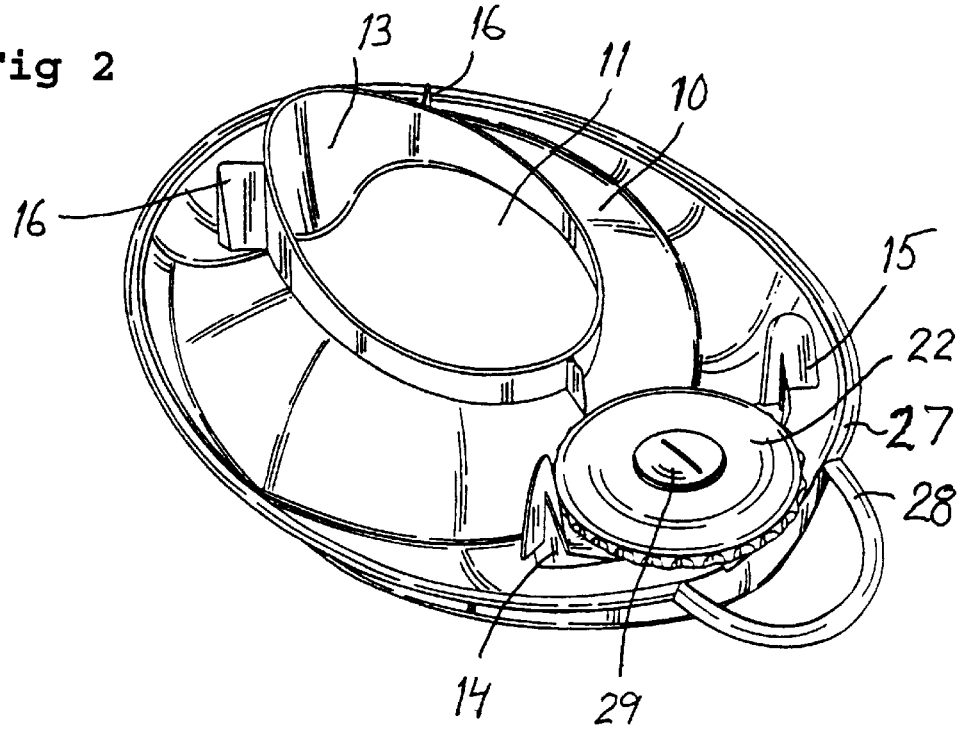
Figure 3:
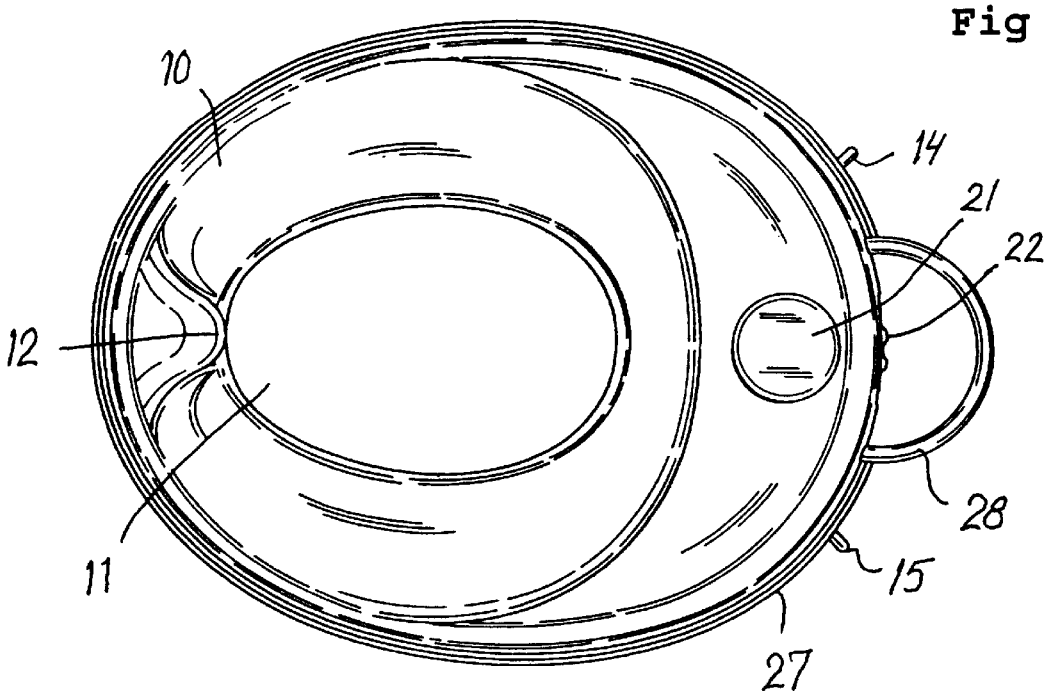
FIGS. 3 and 4 illustrate the toilet seat of FIGS. 1 and 2 from above and from beneath respectively.
Figure 4:
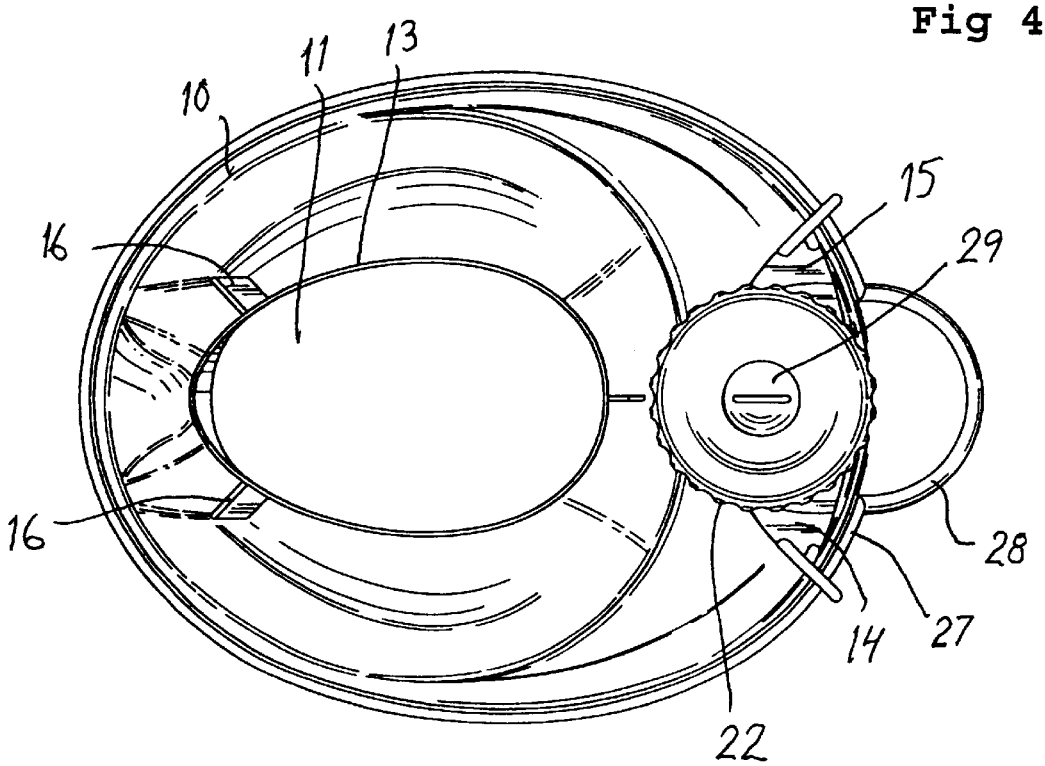

Those components that find correspondence or general correspondence in the different figures of the drawings have been identified with the same reference signs.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The toilet seat illustrated in FIGS. 1–10 is intended for children and designed to be fitted releasably to a toilet bowl (not shown) which may or may not be fitted with a seat ring. However, the inventive principle whereby attachment of a toilet seat to toilet bowls of mutually different sizes and shapes is greatly facilitated can also be applied to the toilet seats of adult toilets, for instance with toilet bowl elevators for adults that are handicapped in some way.

The toilet seat illustrated in FIGS. 1–8 includes a relatively broad seat ring 10 that has an opening 11 which is displaced towards the front end of the ring 10, where said ring is provided with a raised part 12 which functions as a splash guard when urinating. The opening 11 is surrounded by a vertical opening 13, the front wall of which, together with the rear wall of the raised part 12, may conveniently slope obliquely upwards and rearwards, as best seen from FIGS. 2, 4 and 5.

The seat ring 10 is fitted with arms 14, 15 by means of which the toilet seat can be positioned on a toilet bowl. In the illustrated case, the arms 14, 15 are movably mounted on the seat ring 10 and can be adjusted to positions in which they engage opposite inner surfaces of the toilet bowl, or preferably a seat ring already fitted to said bowl. However, with the aid of small modifications within the scope of the invention the arms can be adapted for engagement with the outside of a toilet bowl. Only one pair of arms 14, 15 are provided at the rear part of the seat ring 10, whereas the vertical opening 13 is provided with positioning ribs 16 at the front part of the seat ring 10 for abutment with the inside of the toilet bowl or a seat ring fitted thereto. However, it lies within the scope of the invention to replace these ribs 16 with adjustable arms (not shown) that are arranged in a similar way to the arms 14, 15. These arms are interconnected in pairs, so as to move synchronously in opposite directions when positioning the arms, whereby the toilet seat will be centred in relation to the toilet bowl when bringing the arms into engagement therewith. A particular advantage is afforded when the arms 14, 15 are pivotally mounted, preferably on one and the same pivot shaft 17 (FIG. 5 and FIGS. 8–10).

Figure 5:
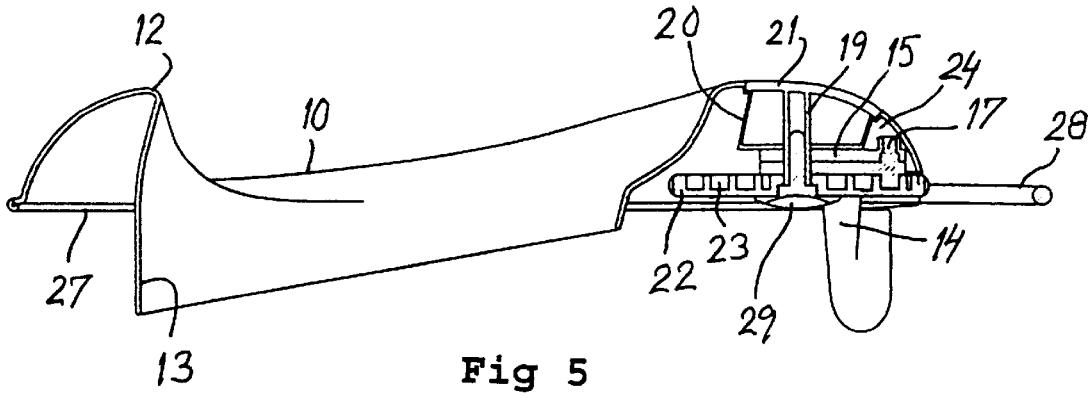
FIG. 5 is a longitudinal sectioned view taken centrally through the toilet seat according to FIGS. 1–4.
Figure 6:
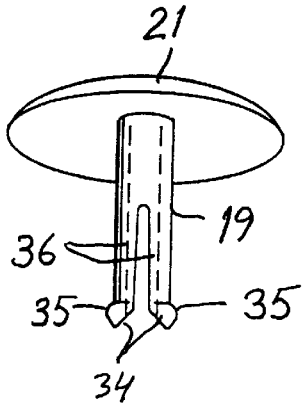
FIGS. 6 and 7 are side views of components of the toilet seat shown in FIG. 5.
Figure 7:
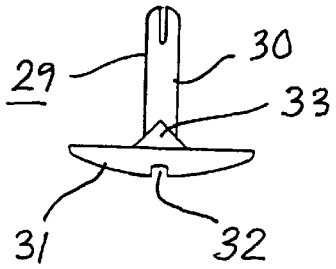
Figure 8:
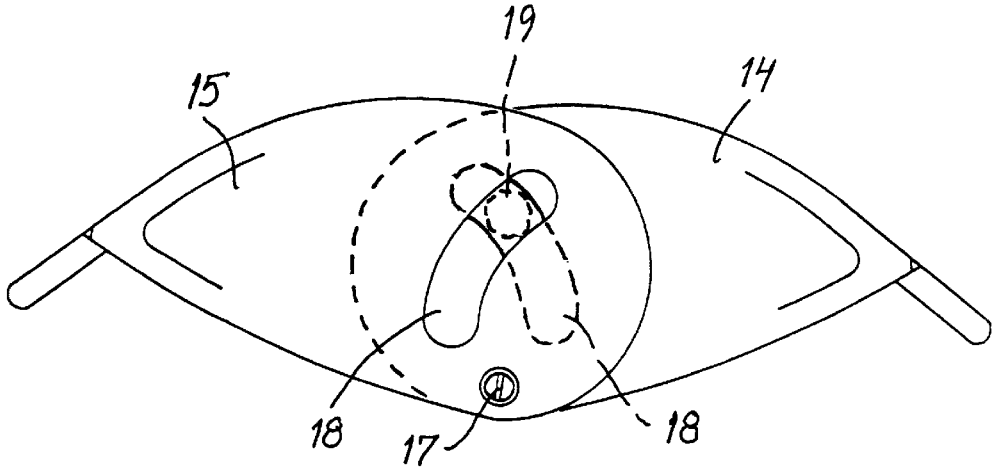
FIG. 8 illustrate pivotal position setting arms shown in FIG. 5 from above.
Figure 9:
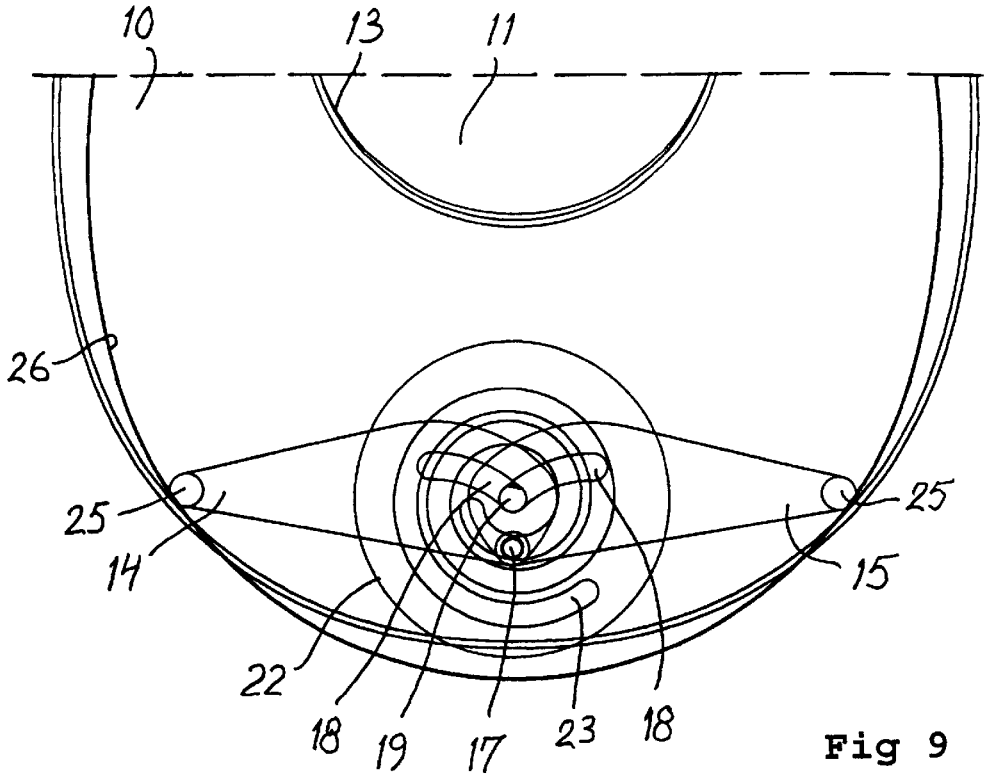
FIGS. 9–10 are schematic partial plan views taken from beneath and illustrating the pivoting principle of the setting arms.
Figure 10:
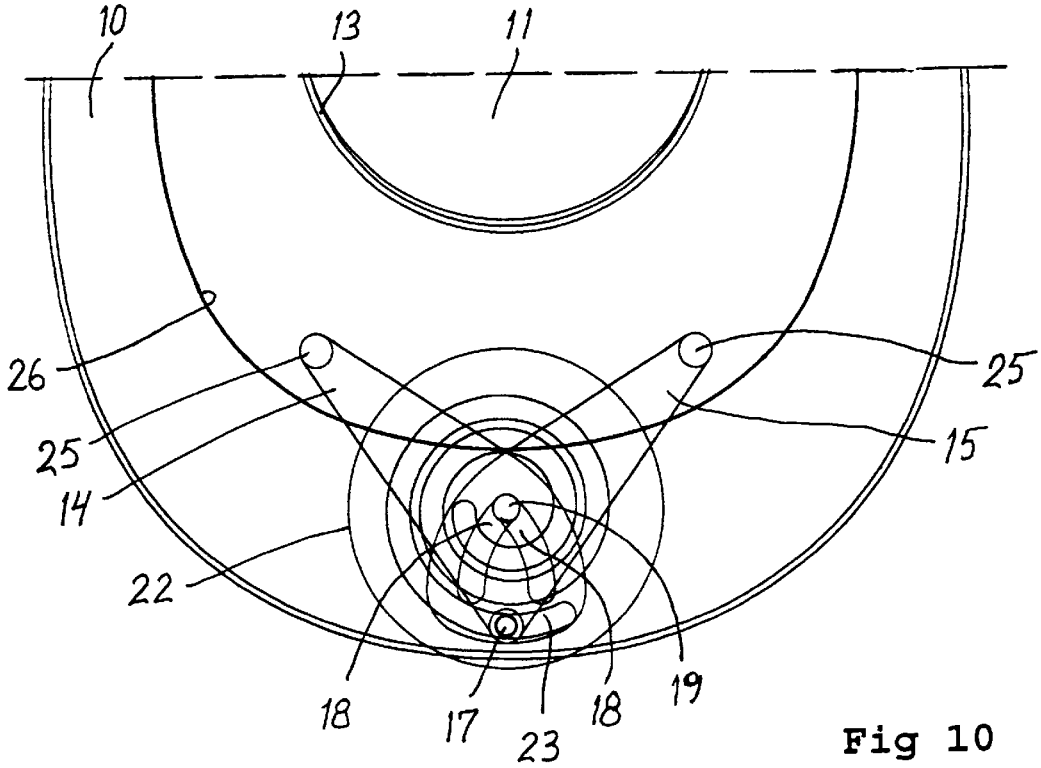

In the illustrated embodiment, the arms 14, 15 shown from the top in FIG. 8 and schematically from beneath in FIGS. 9 and 10, each include a slot 18 which is spaced from the shaft 17. The slots which may be arcuate in shape, as shown, cross one another and are throughpassed by a further shaft 19 which is guided in said slots and which, similar to the shaft 17, is located in the symmetry plane of the toilet seat, as shown in FIG. 5. In order to achieve synchronous rotation of the arms 14, 15 in mutually opposite directions, the shaft 17 is movable towards and away from the immovable shaft 19. A recessed part 20 of the seat ring 10 is covered with a removable lid or cover 21, which carries the immovable shaft 19 and from which said shaft 19 extends down through the bottom of the recessed part 20 and through the slots 18 in the arms 14, 15. The bottom end of the shaft 19 carries a setting knob 22. The latter includes a helical groove 23 into which the movable shaft 17 projects. This latter shaft 17 is guided for movement in the longitudinal direction of the seat. To this end, there extends in the longitudinal direction of the seat between the rear part of the recessed part 20 and the inside of the seat ring 10 a guide groove which is defined by groove walls 24 located on two opposite sides of the symmetry plane, of which walls only one is shown in FIG. 5. Thus, when turning the setting knob 22 the movable shaft 17 will move in the longitudinal direction by virtue of a camming action between said shaft and the helical groove 23, whereby the arms 14, 15 will, in turn, be swung synchronously in mutually opposite directions about the movable shaft 17 by virtue of the camming action between the slots 18 and the immovable shaft 19, while moving simultaneously in unison in the longitudinal direction of the seat, as will be evident when making a comparison between FIGS. 9 and 10. It will be seen that a similar movement pattern of the arms 14, 15 could be achieved by moving the shaft 19 relative to the shaft 17 or by moving both shafts relative to each other to a certain extent. The helical groove 23 will conveniently have a small pitch so as to obtain a self-locking engagement between the shaft 17 and the walls of the groove 23, thereby obviating the need of interlocking the arms 14, 15 in desired positions of rotation.

The arms 14, 15 are shown more schematically in FIGS. 9 and 10, but have principally the same designs as in FIG. 8, i.e. include two plate-like main parts which are pivotally connected at 17 and which have end-parts 25 which are angled relative to the toilet seat and intended for engagement with the inside of a toilet-bowl opening indicated by lines 26. FIGS. 9 and 10 illustrate the arms 14, 15 in a respective maximum and minimum outwardly swung position, where the shaft 19 is located at one or the other end of the slots 18.

In order to enable the toilet seat to be positioned and loosened hygienically, without needing to place ones hands beneath the seat, the setting knob 22 is positioned so as to be accessible from the outside or the upper side of the seat ring 10, as shown in FIGS. 2–5. Thus, the toilet seat can be fitted to a selected toilet bowl, by placing the toilet seat with the arms 14, 15 positioned on the toilet bowl in the manner shown in FIG. 10 for instance, wherewith the setting knob 22 is rotated through the influence of the outwardly and rearwardly extending part of the seat ring 10, in a direction such as to cause the downwardly angled parts 25 of the arms 14, 15 to engage the inside 26 of the toilet-bowl opening. The toilet seat is released, of course, by turning the knob 22 in the opposite direction.

In order to avoid unintentional sliding or slipping of the toilet seat relative to the upper surface of the toilet bowl, a bead-like edge 27 comprised of some anti-slip material, preferably a soft material, is provided around the periphery or outer bottom edge of the seat ring 10. Both the edge 27 and the seat ring 10 are moulded from a plastic material of appropriate quality. This also applies to the remaining components of the toilet seat. A part 28 of the bead-like edge 27 extends out from the seat ring 10 at the rear of the toilet seat, in the form of a loop which forms a seat carrying handle.

The toilet seat can be readily dismantled into its component parts, so as to enable the seat to be cleaned effectively. In the illustrated embodiment (FIGS. 5–8), said components, the shaft 19, the arms 14, 15 and the setting knob 22, are releasably assembled to this end in the following way: The shaft 19 is tubular and has inserted into its end that lies distal from the lid 21 a locking plug 29 which includes a stem 30 that can be inserted into the tubular shaft 19, and a head 31 that is preferably provided with a coin slot 32 by means of which the plug 29 can be turned without needing to use any particular tool to this end. The underside of the head 31 carries a ridge 33 which is intended to be received in a complementary groove 34 in the end of the shaft 19. The locking plug 29 is intended to be held by friction in the bore of the shaft 19 while holding together the arms 14, 15 pivotally mounted at 17 and the knob 22 between the bottom of the recessed part 20 and the head 31 of said plug. The bottom end of the shaft 19 is slotted (FIG. 6) and includes bottom thickenings 35 that can be caused to pass the slots 18 and a central opening in the knob 22 subsequent to radial compression of the shaft-parts 36 separated by said slot. These thickenings 35 then lie against the underside of the knob. The slots in the shaft 19 are widened when inserting the locking plug 29, therewith preventing the parts 36 from springing towards each other, through the coaction of the ridge 33 with the oblique surfaces of the groove 34, such that the thickenings prevent the knob 22 from leaving the shaft 19. As the locking plug 29 is turned, it moves outwardly relative to the shaft 19 by virtue of the camming action between the ridge 33 and the groove 34, therewith enabling the plug to be removed from the shaft. The knob 22 and the arms 14, 15 can then easily be removed form the shaft 19.

It will be understood that the invention is not restricted to the aforedescribed and illustrated exemplifying embodiment thereof and that the invention can be implemented in any desired manner within the scope of the invention as defined in the following claims.

What is claimed is:

1. A toilet seat comprising a seat ring and means for positioning the seat ring relative to a toilet bowl, said positioning means including at least one pair of interconnected arms which are movably mounted on the seat ring and adjustable synchronously to positions in which they engage the toilet bowl, said arms being designed for engagement with mutually opposite inner surfaces or outer surfaces of the toilet bowl and interconnected so as to move synchronously in mutually opposite directions as they are brought to their positional settings, said arms being pivotal about a vertical pivot shaft located in a symmetry plane through said toilet seat.

2. The toilet seat according to claim 1, wherein a forward end of the seat ring carries a fixed seat positioning element, said arms being arranged on a rear end of the seat ring.

3. The toilet seat according to claim 1, wherein said arms are each provided with a slot at a distance from said pivot shaft, said slots mutually intersecting and being throughpassed by a second shaft which is also located in said symmetry plane, one of said pivot and second shafts being moveable towards and away from the other for synchronous rotation of the arms.

4. The toilet seat according to claim 3, wherein said pivot shaft is displaceably received in a guide groove located in said symmetry plane.

5. The toilet seat according to claim 3, wherein said pivot shaft is received in a helical groove provided in a setting knob.

6. The toilet seat according to claim 5, wherein said second shaft is fixed and coincides with a rotational axis of said setting knob.

7. The toilet seat according to claim 6, wherein said helical groove has a sufficiently small pitch to provide self-locking engagement with said pivot shaft.

8. The toilet seat according to claim 5, wherein a peripheral part of said setting knob is accessible from outside the seat ring.

9. The toilet seat according to claim 1, wherein said toilet seat can be dismantled.

10. A toilet seat comprising a seat ring and means for positioning the seat ring relative to a toilet bowl, said positioning means including at least one pair of interconnected arms which are movably mounted on the seat ring and adjustable synchronously to positions in which they engage the toilet bowl, said arms designed for engagement with mutually opposite inner surfaces or outer surfaces of the toilet bowl and interconnected so as to move synchronously in mutually opposite directions as they are brought to their positional settings, said toilet seat further including a bead-like edge of anti-slip material molded to a periphery of the seat ring.

11. The toilet seat according to claim 10, wherein a part of said bead-like edge is formed as a seat carrying handle.

12. The toilet seat according to claim 10, wherein said anti-slip material is a soft material.

13. The toilet seat according to claim 10, wherein said arms are pivotal about a vertical pivot shaft located in a symmetry plane through the toilet seat.

14. The toilet seat according to claim 13, wherein each of said arms includes a slot at a distance from said pivot shaft, said slots mutually intersecting and being through-passed by a second shaft which is also located in said symmetry plane, one of said pivot shaft and said second shaft being moveable towards and away from the other for synchronous rotation of the arms.

15. A toilet seat for a toilet bowl comprising a seat ring and a pair of interconnected arms which are movably mounted on the seat ring and synchronously adjustable in mutually opposite directions to positions in which they engage mutually opposite inner surfaces or outer surfaces of the toilet bowl, said arms being pivotal about a vertical pivot shaft located in a symmetry plane through said toilet seat.

16. The toilet seat according to claim 15, wherein each of said arms has a slot at a distance from said pivot shaft, said slots mutually intersecting and through-passed by a fixed shaft which is also located in said symmetry plane, said pivot shaft being moveable towards and away from said fixed shaft for synchronous rotation of the arms.

17. The toilet seat according to claim 16, wherein said pivot shaft is displaceably received in a guide groove located in said symmetry plane.

18. The toilet seat according to claim 17, wherein said pivot shaft is also received in a helical groove provided in a setting knob.

19. The toilet seat according to claim 18, wherein said fixed shaft coincides with a rotational axis of said setting knob.

20. The toilet seat according to claim 18, wherein said helical groove has a sufficiently small pitch to provide self-locking engagement with said pivot shaft.

* * * * *